US005858022A

United States Patent [19]

Romack et al.

[11] Patent Number: 5,858,022

[45] Date of Patent: Jan. 12, 1999

[54] DRY CLEANING METHODS AND COMPOSITIONS

[75] Inventors: Timothy J. Romack, Durham; David F. Cauble, Raleigh; James B. McClain, Durham, all of N.C.

[73] Assignee: MiCell Technologies, Inc., Raleigh, N.C.

[21] Appl. No.: 921,620

[22] Filed: Aug. 27, 1997

[51] Int. Cl.[6] ..... D06L 1/00; D06L 1/02

[52] U.S. Cl. ..... 8/142; 8/137; 8/158; 8/159; 8/149.1; 8/149.2; 510/285; 510/291; 510/289; 510/290; 510/405; 510/407; 510/413

[58] Field of Search ..... 8/142, 137, 158, 8/159, 149.1, 149.2; 510/285, 291, 289, 290, 407, 413, 405

[56] References Cited

U.S. PATENT DOCUMENTS

| | | | |
|---|---|---|---|
| 4,912,793 | 4/1990 | Hagiwara | 8/158 |
| 5,267,455 | 12/1993 | Dewees et al. | 68/5 C |
| 5,279,615 | 1/1994 | Mitchell et al. | 8/142 |
| 5,370,742 | 12/1994 | Mitchell et al. | 134/10 |
| 5,377,705 | 1/1995 | Smith, Jr. et al. | 134/95.3 |
| 5,412,958 | 5/1995 | Iliff et al. | 68/5 C |
| 5,431,843 | 7/1995 | Mitchell et al. | 252/186.38 |
| 5,467,492 | 11/1995 | Chao et al. | 8/159 |
| 5,486,212 | 1/1996 | Mitchell et al. | 8/142 |
| 5,669,251 | 9/1997 | Townsend et al. | 68/58 |
| 5,676,705 | 10/1997 | Jureller et al. | 8/142 |
| 5,683,473 | 11/1997 | Jureller et al. | 8/142 |
| 5,683,977 | 11/1997 | Jureller et al. | 510/286 |
| 5,759,209 | 6/1998 | Adler et al. | 8/142 |

FOREIGN PATENT DOCUMENTS

| | | |
|---|---|---|
| 0 518 653 A1 | 6/1992 | European Pat. Off. . |
| 3904514 A1 | 8/1990 | Germany . |
| WO 96/27704 | 9/1996 | WIPO . |

OTHER PUBLICATIONS

Manfred Wentz; *Textile Cleaning with Carbon Dioxide?*; Copyright © 1995 By R.R. Street & Co. Inc. (Month Unknown).

*Primary Examiner*—Alan Diamond

*Attorney, Agent, or Firm*—Myers Bigel Sibley & Sajovec, P.A.

[57] ABSTRACT

A method for dry-cleaning articles such as fabrics and clothing in carbon dioxide comprises contacting an article to be cleaned with a liquid dry cleaning composition for a time sufficient to clean the fabric. The liquid dry-cleaning composition comprises a mixture of carbon dioxide, water, a surfactant, and an organic co-solvent. After the contacting step, the article is separated from the liquid dry cleaning composition. The method is preferably carried out at ambient temperature. The surfactant may be either one that contains a $CO_2$-philic group or one that does not contain a $CO_2$-philic group. The organic co-solvent is preferably an alkane that has a flash point above 140° F.

26 Claims, No Drawings

DRY CLEANING METHODS AND COMPOSITIONS

FIELD OF THE INVENTION

The present invention relates to methods and compositions for carrying out the dry-cleaning of fabrics (e.g., garments) in liquid carbon dioxide.

BACKGROUND OF THE INVENTION

Commercial dry cleaning systems currently employ potentially toxic and environmentally harmful halocarbon solvents, such as perchloroethylene. Carbon dioxide has been proposed as an alternative to such systems in U.S. Pat. No. 4,012,194 to Maffei. A problem with carbon dioxide is, however, its lower solvent power relative to ordinary solvents.

PCT Application WO96/27704 (12 Sep. 1996) by Unilever, describes dry cleaning systems using densified carbon dioxide and special surfactant adjuncts. The term "densified carbon dioxide" means "carbon dioxide in a gas form which is placed under pressures exceeding about 700 psi at about 20° C." (pg. 5, lines 1–3). The surfactants employed have a supercritical fluid $CO_2$-philic moiety connected to a supercritical fluid $CO_2$-phobic moiety (pg 3, lines 30–32). In the method and apparatus described, a vertical rotating drum 5 (FIG. 1) containing soiled fabrics, surfactants, modifier, enzyme, peracid and mixtures thereof is charged with densified $CO_2$ fluid at a pressure ranging between 700 and 10,000 psi. The $CO_2$ is then heated to its supercritical range of about 20° C. to about 60° C. by a heat exchanger 4 (pg. 36 line 26 to pg. 37 line 8) and the cleaning cycle initiated. Other densified molecules that have supercritical properties, ranging from methane and ethane through n-heptane to sulfur hexafluoride and nitrous oxide, are noted that may also be employed in the described process, alone or in mixture with $CO_2$ (pg. 6 lines 25–35).

A problem with the Unilever dry-cleaning technique is that supercritical $CO_2$ is extremely damaging to some fabrics and buttons used in clothing. In addition, the need for a heater makes the process more energy intensive and expensive, and the need for a container that can hold $CO_2$ at supercritical temperatures and pressures makes it difficult or impossible to practice the process on conventional dry-cleaning apparatus. Further, because the $CO_2$ is supercritical, there is no phase boundary in the rotating drum, such as the liquid-vapor boundary found in most traditional dry cleaning process. The presence of the phase boundary in the rotating drum (particularly in horizontal rotating drums) exerts a physical scrubbing and penetrating action on the garments that enhances the cleaning thereof.

U.S. Pat. No. 5,377,705 to Smith et al. describes a precision cleaning system in which a work piece is cleaned with a mixture of $CO_2$ and a co-solvent. Smith provides an entirely non-aqueous system, stating: "The system is also designed to replace aqueous or semi-aqueous based cleaning processes to eliminate the problems of moisture damage to parts and water disposal" (col. 4 line 68 to col. 5 line 3). Co-solvents that are listed include acetone and ISOPAR™ (col. 8, lines 19–24). Use in dry cleaning is neither suggested nor disclosed. Indeed, since some water must be present in dry-cleaning, such use is contrary to this system.

In view of the foregoing, there is a continuing need for effective carbon dioxide-based dry cleaning systems.

SUMMARY OF THE INVENTION

A method for dry-cleaning articles such as fabrics and clothing in carbon dioxide comprises contacting an article to be cleaned with a liquid dry cleaning composition for a time sufficient to clean the fabric. The liquid dry-cleaning composition comprises a mixture of carbon dioxide, water, a surfactant, and an organic co-solvent. After the contacting step, the article is separated from the liquid dry cleaning composition.

Preferably, the liquid dry cleaning composition is at ambient temperature, of about 0° C. to 30° C. In one embodiment; the surfactant contains a $CO_2$-philic group; in another embodiment, the surfactant does not contain a $CO_2$-philic group.

DETAILED DESCRIPTION OF THE INVENTION

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particulare soils (i.e., soils containing insoluble solid components such as silicates, carbon black, etc.).

Articles that can be cleaned by the method of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

Liquid dry-cleaning compositions useful for carrying out the present invention typically comprise:

(a) from 0.1 to 10 percent (more preferably from 0.1 to 4 percent) water;

(b) carbon dioxide (to balance; typically at least 30 percent);

(c) surfactant (preferably from 0.1 or 0.5 percent to 5 or 10 percent); and (d) from 0.1 to 50 percent (more preferably 4 to 30 percent) of an organic co-solvent.

Percentages herein are expressed as percentages by weight unless otherwise indicated.

The composition is provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes in combination with additional compounds such as one or more alcohols (e.g., from 0 or 0.1 to 5% of a C1 to C15 alcohol (including diols, triols, etc.)).

Any surfactant can be used to carry out the present invention, including both surfactants that contain a $CO_2$-philic group (such as described in PCT Application WO96/27704) linked to a $CO_2$-phobic group (e.g., a lipophilic group) and surfactants that do not contain a $CO_2$-philic group (i.e., surfactants that comprise a hydrophilic group linked to a hydrophobic (typically lipophilic) group). A single surfactant may be used, or a combination of surfactants may be used. Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, a diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

As will be apparent to those skilled in the art, numerous additional ingredients can be included in the dry-cleaning composition, including detergents, bleaches, whiteners, softeners, sizing, starches, enzymes, hydrogen peroxide or a source of hydrogen peroxide, fragrances; etc.

In practice, in a preferred embodiment of the invention, an article to be cleaned and a liquid dry cleaning composition as given above are combined in a closed drum. The liquid dry cleaning composition is preferably provided in an amount so that the closed drum contains both a liquid phase and a vapor phase (that is, so that the drum is not completely filled with the article and the liquid composition). The article is then agitated in the drum, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed by any suitable means, including both draining and venting.

Any suitable cleaning apparatus may be employed, including both horizontal drum and vertical drum apparatus. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition. Finally, in an alternate embodiment of the invention, agitation may be imparted by means of jet agitation as described in U.S. Pat. No. 5,467,492 to Chao et al., the disclosure of which is incorporated herein by reference. As noted above, the liquid dry cleaning composition is preferably an ambient temperature composition, and the agitating step is preferably carried out at ambient temperature, without the need for associating a heating element with the cleaning apparatus.

The present invention is explained in greater detail in the following non-limiting examples.

EXAMPLES

This example shows that various $CO_2$ detergent formulations show a significantly enhanced cleaning effect over a commercial perchloroethylene ("perc") dry cleaning system. Small (2"×2") swatches of various delicate (often "dry clean only") cloth were uniformly stained and run in both perc and $CO_2$ cleaning systems. Two $CO_2$ cleaning systems were employed, as follows:

FIRST:

0.5% X-207 (a commercial detergent from Union Carbide—nonyl phenyl ethoxylate with a hydrophobic-lipophilic balance (HLB) of about 10.5);

0.5% PDMS-$g_3$-PEG (polydimethyl siloxane-graft-polyethylene glycol copolymer) (500 g/mol PDMS with 350 g/mol peg grafts ca. 50 wt % PEG);

1% Span™ 80 (a commercial sorbitan ester surfactant from ICI);

0.5% isopropanol;

0.2% water;

30% Isopar™ (a commercial hydrocarbon solvent manufactured by EXXON); and $CO_2$ to balance; or

SECOND:

1% X-207;

1% Span™ 80;

1% isopropanol;

0.2% water;

30% Isopar™ M; and $CO_2$ to balance.

The second system above is currently preferred.

At a temperature of 22° C. to 27° C., the formulation and cloth was added to the test vessel. The test vessel was pressurized with liquid $CO_2$ to 800–900 psi, with the total liquid volume equal to about half the vessel volume. The cloth was washed with agitation for ten minutes. To rinse, the liquid $CO_2$ was vented, the cloth spun for five minutes, liquid $CO_2$ was again added and pressurized to 800 to 900 psi until the vessel was one half full, and the cloth again agitated for five minutes. The rinse cycle (vent, spin, agitate) was repeated, the system vented and the cloth removed.

Control "perc" samples were run in perchloroethylene using a standard loading of Fabritech™ detergent and sizing, at a local commercial dry cleaner under normal operating conditions. In each case the stained samples of cloth were washed in one of the $CO_2$ mixtures described above, followed by extraction and rinse with clean $CO_2$.

The following cloth samples were run:

1. White linen suiting
2. Acetate taffeta

3. Silk twill
4. 100% wool flannel
5. Bright filament viscose twill
6. Texturized nylon 6,6 stretch fabric
7. Texturized stretch Dacron™

Results are given in Table 1 below. These data show that $CO_2$-based dry cleaning formulations of the present invention have an enhanced cleaning effect as compared to a commercial PERC dry cleaning system.

TABLE 1

| Cloth | Stain | PERC result | CO2 result |
|---|---|---|---|
| 2, 4, 1 | French salad dressing | slight residue remaining | visually clean, no residue |
| 1, 2, 3, 4, 6 | Spaghetti sauce | majority of stain remaining | slight residue remaining |
| 5 | Tea | over ½ of residue remaining, plus darkening of 'ring' around the stained area | slight residue remaining, no 'ring' apparent |
| 2 | Tea | slight residue remaining | visually clean, no residue |
| 5 | Blackberry juice | slight residue remaining | visually clean, no residue |
| 4, 5, 7 | Grass | slight residue remaining | minute residue remaining[1] |
| 4 | Coke ™ cola beverage | ½ of stain remaining | minute residue remaining |
| 4 | Coffee | ½ of stain remaining | minute residue remaining |
| 1 | Egg | no significant removal of stain, slight color change of stain | slight residue remaining |
| 1, 2, 4, 6 | taco sauce | majority of stain remaining | slight residue remaining |

[1]By "minute" is meant significantly less than the perc result.

The foregoing is illustrative of the present invention, and is not to be construed as limiting thereof. The invention is defined by the following claims, with equivalents of the claims to be included therein.

That which is claimed is:

1. A method for dry-cleaning garments or fabrics in carbon dioxide, comprising:

contacting a garment or fabric article to be cleaned with a liquid dry cleaning composition for a time sufficient to clean the article, said liquid dry-cleaning composition comprising a mixture of carbon dioxide, water, surfactant, and an organic co-solvent; and then separating the article from the liquid dry cleaning compositions and wherein said surfactant does not contain a $CO_2$-philic group.

2. A method according to claim 1, wherein said liquid dry cleaning composition is at a temperature of 0° C. to 30° C.

3. A method according to claim 1, wherein said organic co-solvent has a flash point above 140° F.

4. A method according to claim 1, wherein said organic co-solvent has a flash point above 170° F.

5. A method according to claim 1, wherein said organic co-solvent has a flash point above 200° F.

6. A method according to claim 1, wherein said organic co-solvent is a hydrocarbon co-solvent.

7. A method according to claim 1, wherein said organic co-solvent is an alkane co-solvent.

8. A method according to claim 7, said liquid dry cleaning composition further comprising an alcohol.

9. A method according to claim 1 wherein said contacting step is carried out by jet agitation.

10. A method for dry-cleaning garments or fabrics in carbon dioxide, comprising:

(a) combining a garment or fabric article to be cleaned and a liquid dry cleaning composition in a closed drum so that said closed drum contains both a liquid phase and a vapor phase, said liquid dry cleaning composition comprising a mixture of liquid carbon dioxide, water, surfactant, and a hydrocarbon co-solvent;

(b) agitating said article in said drum so that said article contacts both said liquid dry cleaning composition and said vapor phase for a time sufficient to clean said article; and then (c) removing the cleaned article from said drum;

and wherein said surfactant does not contain a $CO_2$-philic group.

11. A method according to claim 10, wherein said drum is a horizontal rotating drum, and said agitating step is carried out by rotating said drum.

12. A method according to claim 10, wherein said drum is a vertical drum having an agitator positioned therein, and said agitating step is carried out by moving said agitator.

13. A method according to claim 10, wherein said liquid dry cleaning composition is a room-temperature composition and said agitating step is carried out at a temperature of 0° C. to 30° C.

14. A method according to claim 10, wherein said organic co-solvent has a flash point above 140° F.

15. A method according to claim 10, wherein said organic co-solvent has a flash point above 170° F.

16. A method according to claim 10, wherein said organic co-solvent has a flash point above 200° F.

17. A method according to claim 10, wherein said organic co-solvent is an alkane co-solvent.

18. A method according to claim 10, said liquid dry cleaning composition further comprising an alcohol.

19. A liquid dry-cleaning composition, useful for carrying out dry cleaning in carbon dioxide at or about room temperature and vapor pressure, said composition comprising:

(a) from 0.1 to 10 percent water;

(b) carbon dioxide;

(c) from 0.1 to 10 percent surfactant; and (d) from 0.1 to 50 percent of an organic co-solvent;

and wherein said surfactant does not contain a $CO_2$-philic group.

20. A liquid dry-cleaning composition according to claim 19, said composition comprising:

(a) from 0.1 to 4 percent water;

(b) carbon dioxide;

(c) from 0.5 to 5 percent surfactant; and (d) from 4 to 30 percent of an organic co-solvent.

21. A composition according to claim 19, wherein said organic co-solvent has a flash point above 140° F.

22. A composition according to claim 19, wherein said organic co-solvent has a flash point above 170° F.

23. A composition according to claim 19, wherein said organic co-solvent has a flash point above 200° F.

24. A composition according to claim 19, wherein said organic co-solvent is a hydrocarbon co-solvent.

25. A composition according to claim 19, wherein said organic co-solvent is an alkane co-solvent.

26. A composition according to claim 1, further comprising an alcohol.

* * * * *

UNITED STATES PATENT AND TRADEMARK OFFICE

CERTIFICATE OF CORRECTION

PATENT NO. : 5,858,022

DATED : January 12, 1999

INVENTOR(S) : Timothy J. Romack, David F. Cauble, James B. McClain

It is certified that error appears in the above-indentified patent and that said Letters Patent is hereby corrected as shown below:

Column 5, lines 48-49, Delete "compositions" and insert --composition-- .

Column 6, line 64, Delete "claim 1" and insert -- claim 25 --therefor--

Signed and Sealed this

Twentieth Day of March, 2001

Nicholas P. Godici

*Attest:*

NICHOLAS P. GODICI

*Attesting Officer*

*Acting Director of the United States Patent and Trademark Office*